US006139422A

United States Patent [19]

Blaschke

[11] Patent Number: 6,139,422

[45] Date of Patent: Oct. 31, 2000

[54] EXHAUST GAS EXTRACTION APPARATUS FOR A VEHICLE SHED

[76] Inventor: Hans Blaschke, Industriestrasse 13, D86405, Meitingen, Germany

[21] Appl. No.: 09/317,650

[22] Filed: May 24, 1999

[30] Foreign Application Priority Data

May 28, 1998 [DE] Germany ..... 198 23 857

[51] Int. Cl.[7] ..... B08B 15/02

[52] U.S. Cl. ..... 454/63; 454/166

[58] Field of Search ..... 454/63, 64, 903, 454/166; 285/238, 235

[56] References Cited

U.S. PATENT DOCUMENTS

| | | | |
|---|---|---|---|
| 4,660,465 | 4/1987 | Jentzsch et al. . | |
| 5,092,228 | 3/1992 | Pfeiffer, Jr. et al. | 454/63 |
| 5,162,017 | 11/1992 | Nordin | 454/63 |
| 5,362,273 | 11/1994 | Pfeiffer, Jr. et al. | 454/63 |
| 5,453,048 | 9/1995 | Zima et al. | 454/63 |
| 5,542,250 | 8/1996 | Ball et al. | 60/315 |
| 6,012,978 | 1/2000 | Svensson et al. | 454/63 |

FOREIGN PATENT DOCUMENTS

| | | |
|---|---|---|
| 97/21499 | 6/1997 | WIPO . |
| WO 97/21499 | 6/1997 | WIPO . |

OTHER PUBLICATIONS

Brochure entitled Abgas–Absaug–System "Air–Track" of the company Blaschke GmbH; Jan. 1996 (5 pages).

*Primary Examiner*—Denise L. Ferensic
*Assistant Examiner*—Alein Cadalso
*Attorney, Agent, or Firm*—Flynn, Thiel, Boutell & Tanis, P.C.

[57] ABSTRACT

An exhaust gas extraction apparatus for a vehicle shed includes a running rail arranged in the exit direction of a vehicle in an upper shed region, with a carriage which can travel thereon and an extraction hose hanging down therefrom, with an extraction socket disposed at its lower, free end and capable of being clamped onto the exhaust of the vehicle. A connecting hose which can extend elastically in its longitudinal direction, is connected at one end to the carriage and at the other end to a collecting line and is carried from the running rail by a plurality of supports with rollers which can move in the running rail. A brake device is arranged on the carriage, with a movable brake shoe which can be pressed onto the running rail in its braking position by a pneumatic, electrical, electromagnetic or mechanical actuating device. A control device is also provided which acts through a control pulse on the actuating device on release of the extraction socket from the exhaust. The actuating device then brings the brake shoe into the braking position.

10 Claims, 8 Drawing Sheets

EXHAUST GAS EXTRACTION APPARATUS FOR A VEHICLE SHED

FIELD OF THE INVENTION

This invention relates an exhaust gas extraction apparatus for a vehicle shed, with a running rail arranged in the exit direction of the vehicle in the upper shed region, a carriage which can travel thereon, an extraction hose hanging down from the carriage, with an extraction socket disposed at its lower, free end and capable of being clamped on to the exhaust, and a connecting hose which can extend elastically in its longitudinal direction, which is connected at one end to the carriage and at the other end to a collecting line or the like and which is carried from the running rail by means of a plurality of supports with rollers which can move in the running rail.

BACKGROUND OF THE INVENTION

In one such known exhaust gas extraction apparatus (cf. Brochure of the Company Blaschke GmbH, D-86405 Meitingen, "'Air Track' Abgas-Absaug-System") the carriage can move freely. The known exhaust gas extraction apparatus serves to extract exhaust gases from commercial vehicles in operational and parking sheds in fire stations, ambulance stations and other operational areas. When the vehicle is stationary the extraction hose is clamped on to the exhaust of the vehicle by means of the extraction socket. When starting and driving off the vehicle, the extraction socket initially stays on the exhaust, so that the exhaust gases are sucked off and do not get into the vehicle shed. As the vehicle drives off the extraction hose is pulled along by the exhaust and draws the carriage behind it. The connecting hose is extended elastically. A control cam or the like is arranged at a predetermined point on the running rail and effects the release of the extraction socket as soon as the exhaust of the departing vehicle has passed the exit door and is located outside the vehicle shed. However, when the extraction socket is released from the exhaust, there is no longer any pull on the extraction hose and the carriage is pulled back by the elastically tensioned connecting hose. The carriage also pulls with it the extraction hose and the extraction socket connected thereto, which can result in injury to persons. Moreover the extraction hose and the extraction socket come to rest a long way from the door region. This has the disadvantage that, on return of the vehicle, the driver has firstly to pull the extraction socket and the extraction hose back to the door region. Since this is inconvenient, what happens is that the driver moves his vehicle so far back into the vehicle shed that the exhaust is near to the extraction hose, so that he then only has to lift the extraction socket and clamp it on to the exhaust. However this has the disadvantage that exhaust gases get into the vehicle shed.

SUMMARY OF THE INVENTION

The invention is therefore based on the object of providing an exhaust gas extraction apparatus for a vehicle shed of the kind initially referred to which is more operationally friendly and with which injury to personnel is largely excluded.

This is achieved according to the invention in that a brake device is arranged on the carriage, with a movable brake shoe which can be pressed on to the running rail in its braking position and with a pneumatic, electrical, electromagnetic or mechanical actuating device, and in that a control device is provided which acts through a control pulse on the actuating device on release of the extraction socket from the exhaust, the actuating device for its part bringing the brake shoe into the braking position.

The invention is thus based on the idea of automatically braking the carriage and holding it braked in its front end position, as soon as the exhaust of the departing vehicle has passed the door and the extraction socket is released from the exhaust. The carriage accordingly stops in the door region and is held there by the brake. The extraction hose hanging down from the carriage and the extraction socket are also located in the door region. On return of the vehicle the extraction socket is then available directly in the door region and can be clamped on to the exhaust again directly in the door region, without the driver first having to pull the extraction socket and the extraction hose forward to the door region. This also avoids the driver out of laziness putting the vehicle back in the vehicle shed without clamping on the extraction socket. The introduction of exhaust gases to the vehicle shed is thus also avoided. The braking of the carriage also avoids the carriage being pulled back by the tensioned connecting hose. This also avoids the extraction hose and socket flying back and prevents injury to personnel. When the extraction socket has been clamped on to the exhaust again, the brake is automatically released by the control device, so that the carriage is then freely movable again on the running rail.

An extraction apparatus for a vehicle shed is further known from WO 97/21 499 (cf. in particular page 3, line 22 to page 5, line 28), in which the carriage is pulled forwards with the vehicle in a fixed exhaust gas channel and backwards by a winch under spring tension. On arrival at the shed end the carriage is held in its position by a blocking system on the winch.

A brake shoe arranged on the carriage and which can be pressed on through an actuating device is not anticipated by or derivable from this reference.

BRIEF DESCRIPTION OF THE DRAWINGS

Advantageous arrangements of the invention are characterized in the dependent claims.

The invention is explained in more detail in the following, with reference to embodiments shown in the drawings, in which.

DETAILED DESCRIPTION OF THE INVENTION

Figure 4:
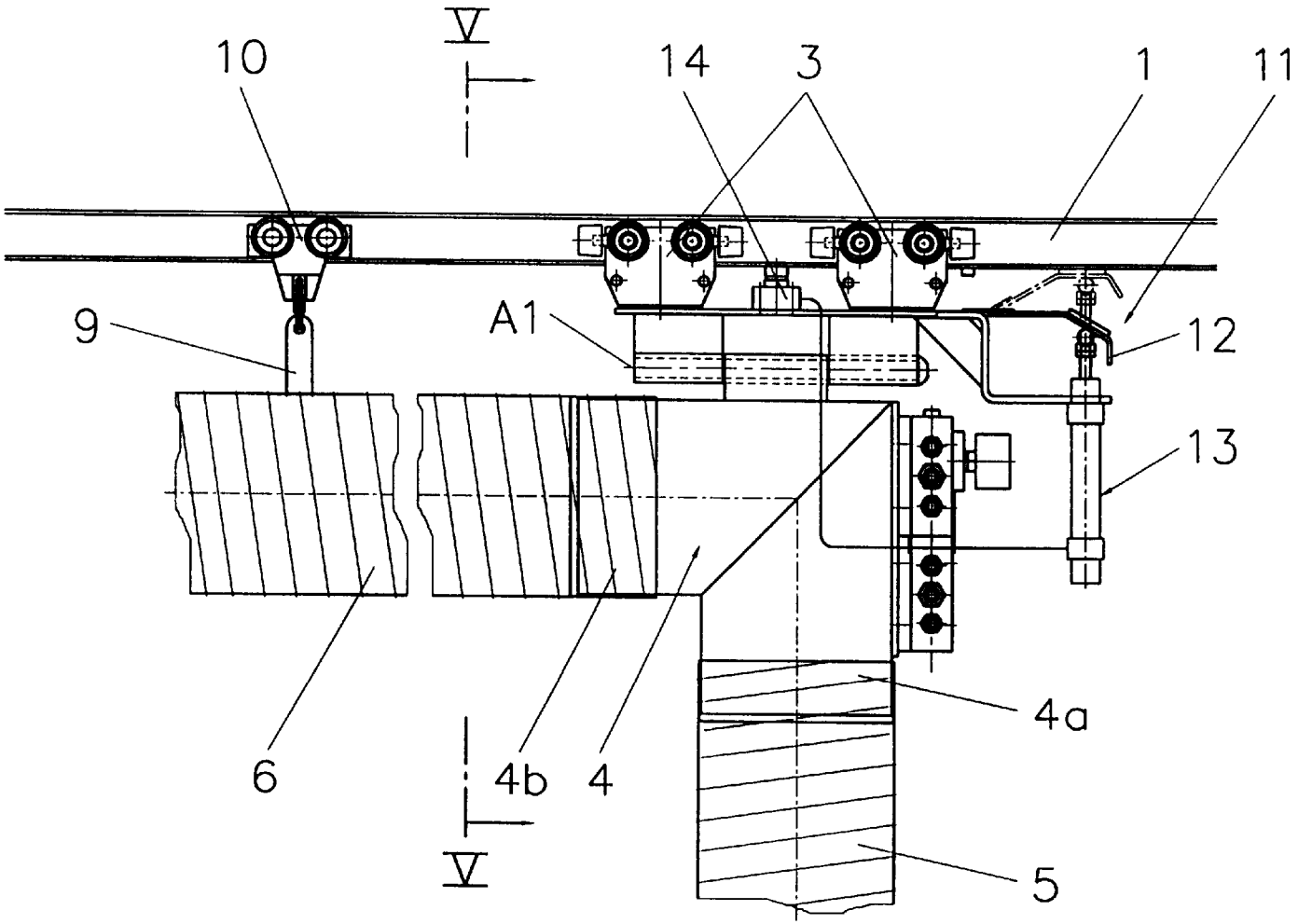
FIG. 4 is a side view of a first embodiment of the carriage and the brake device.
Figure 5:
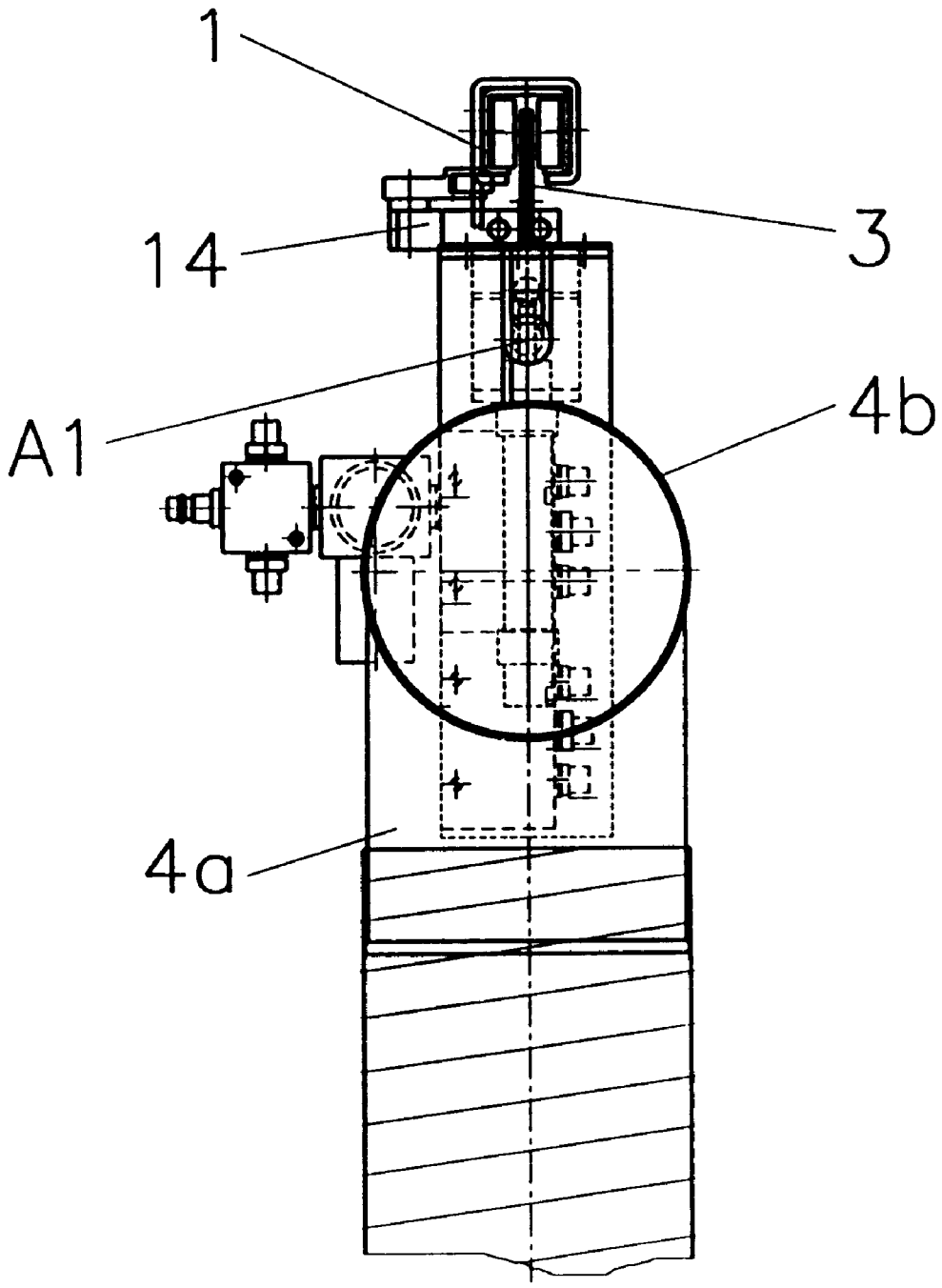
FIG. 5 is a cross-section according to the line V—V in FIG. 4.

The exhaust gas extraction apparatus comprises a running rail 1, which is mounted in the upper shed region of a vehicle shed 2. A carriage 3 can move on the running rail 1 and carries a pipe bend 4. This pipe bend 4 has first pipe connector 4*a* for an elastically extensible extraction hose 5 and a second pipe connector 4*b* for a connecting hose 6 which can extend elastically in its longitudinal direction. The connecting hose 6 is connected to a collecting line 7, which is for its part connected to a ventilating fan, not shown. An extraction socket 8 is disposed on the lower, free end of the extraction hose. This extraction socket can advantageously be an extraction socket in accordance with DE 4 214 908, which has a cuff of rubber which can be pushed on to the exhaust and inflated. By pressurising this cuff can be clamped on the exhaust, whereby on the one hand the exhaust socket 8 is held on the exhaust and on the other hand a seal is produced between the exhaust and the exhaust socket, so that no exhaust gases can escape. Instead of such an extraction socket with an inflatable cuff a purely mechanically acting extraction socket 8' can however be used, as is shown in FIG. 8. The connecting hose is suspended from the running rail 1 by means of a plurality of supports 9, which each have rollers 10 which move in the running rail 1. A movable brake shoe 12 is further arranged on the carriage 3. This brake shoe 12 can be pressed against the underside of the running rail 1 in the braking position. In order to actuate the brake shoe 12 a pneumatic actuating device 13 is provided in the embodiment shown in FIGS. 4 and 5 and a mechanical actuating device 13' in the embodiment shown in FIGS. 6 to 8. However an electrical or electromagnetic actuating device would also be possible. Furthermore there is a control device 14 according to FIGS. 4 and 5, which acts on the actuating device 13. This control device 14 involves a switch and a pneumatic control device whose function will be explained in more detail below. In the embodiment shown in FIGS. 6 to 8 the control device 14' is of mechanical design.

Figure 2:
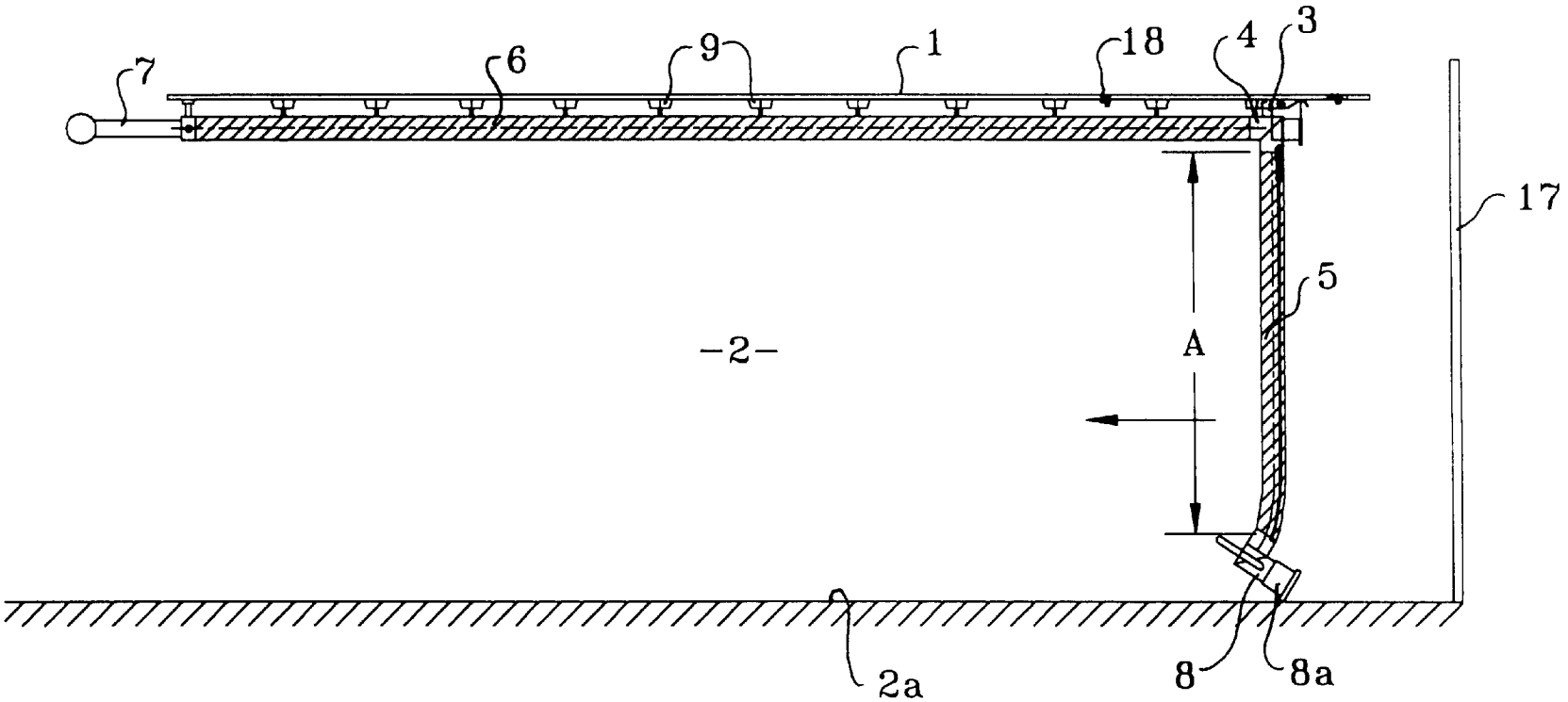
FIG. 2 is side view of the apparatus in the forward stand-by position in the door region.
Figure 3:
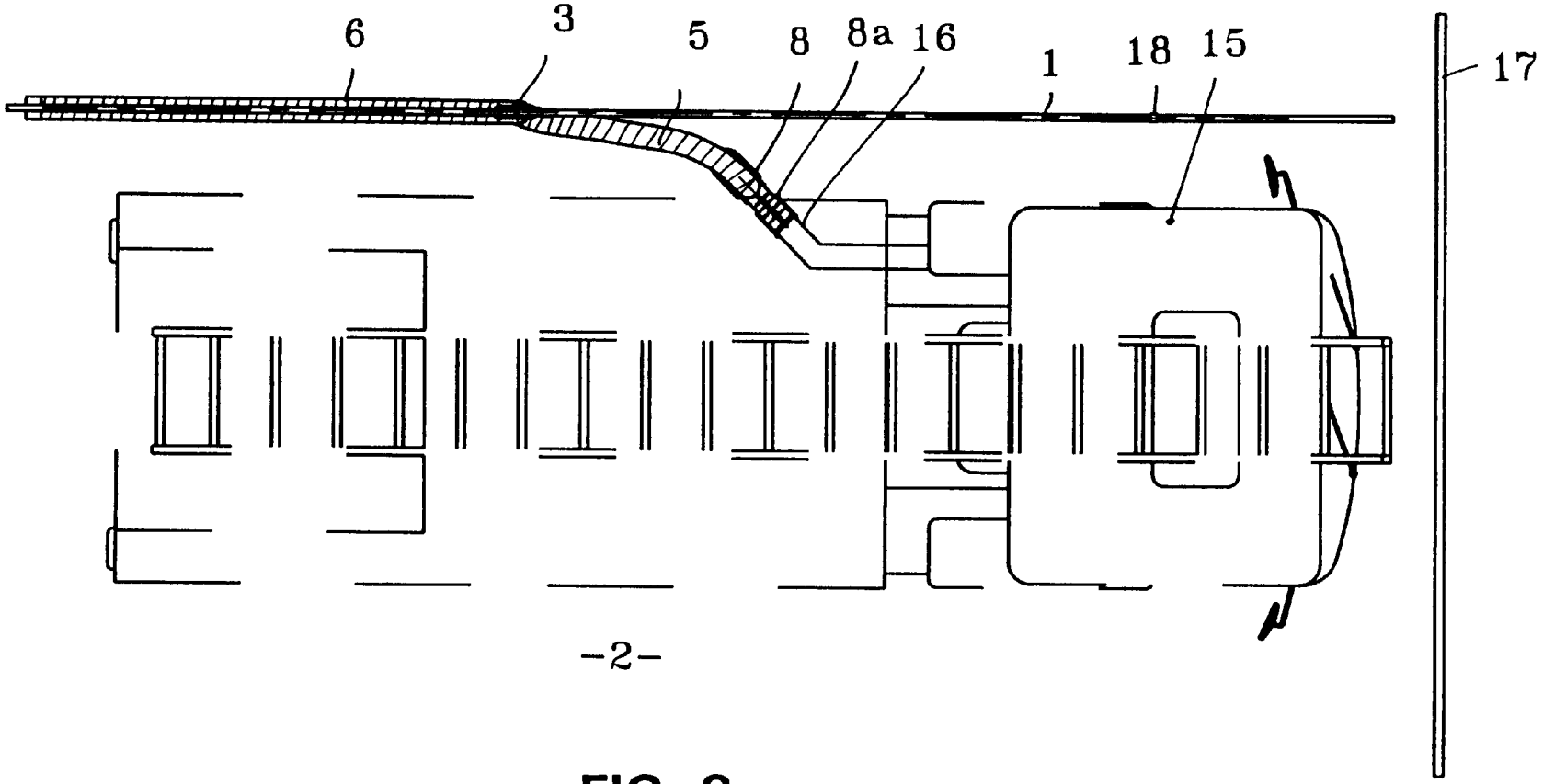
FIG. 3 is plan view of the apparatus in its rear rest position.

The manner of operation of the described apparatus is as follows:

When a vehicle 15 is in the vehicle shed 12, the extraction socket 8 is clamped on to the exhaust 16 of the vehicle 15 by means of its pressurised inflatable cuff 8*a*. A tight seal between the exhaust 16 and the extraction system 5 to 8 is thus produced. When the vehicle 15 starts and drives off, the extraction socket 8 stays clamped fast on the exhaust 16. While driving off, the vehicle 15 therefore pulls the extraction hose 5 behind it, whereby the carriage 3 is also pulled along with simultaneous extension of the connecting hose 6. When the exhaust 16 approaches the region of the door 17, the carriage 3 arrives at the region of the control cam 18 arranged on the running rail 1, whereby a switch of the control device 14 arranged on the carriage 3 is actuated. The control device provides for venting the cuff 8*a*, so that this comes free from the exhaust 16 and the extraction socket is pushed off the exhaust by a push-off device integrated therein. At the same time or with a time delay, the pneumatic cylinder 13 provided as the actuating device is pressurised with compressed air through the control device 14. The piston rod 13*a* presses the brake shoe 12 on to the running rail 1 and thus brakes the carriage 3. The carriage 5 thus comes to a standstill in the door region, as is shown in FIG. 2. The pressurisation of the pneumatic cylinder 13 is furthermore maintained, so that the carriage 3 remains braked and the extraction hose 5 and the extraction socket 8 are located in the region of the door 17 in a stand-by position. The braked carriage 3 can also not be pulled back into its original rest position under the action of the elastically tensioned connecting hose 6. On return of the vehicle it is driven into the vehicle shed 2 until its exhaust 16 is in the vicinity of the door 17. The extraction socket 8 likewise there in its stand-by position is ready to be grasped and can be pushed on with its cuff 8*a* on the exhaust 16 again. The cuff 8*a* is again pressurised with compressed air via the control device 14, by operation of a switch, not shown, and the pneumatic cylinder 13 is vented.

Figure 1:
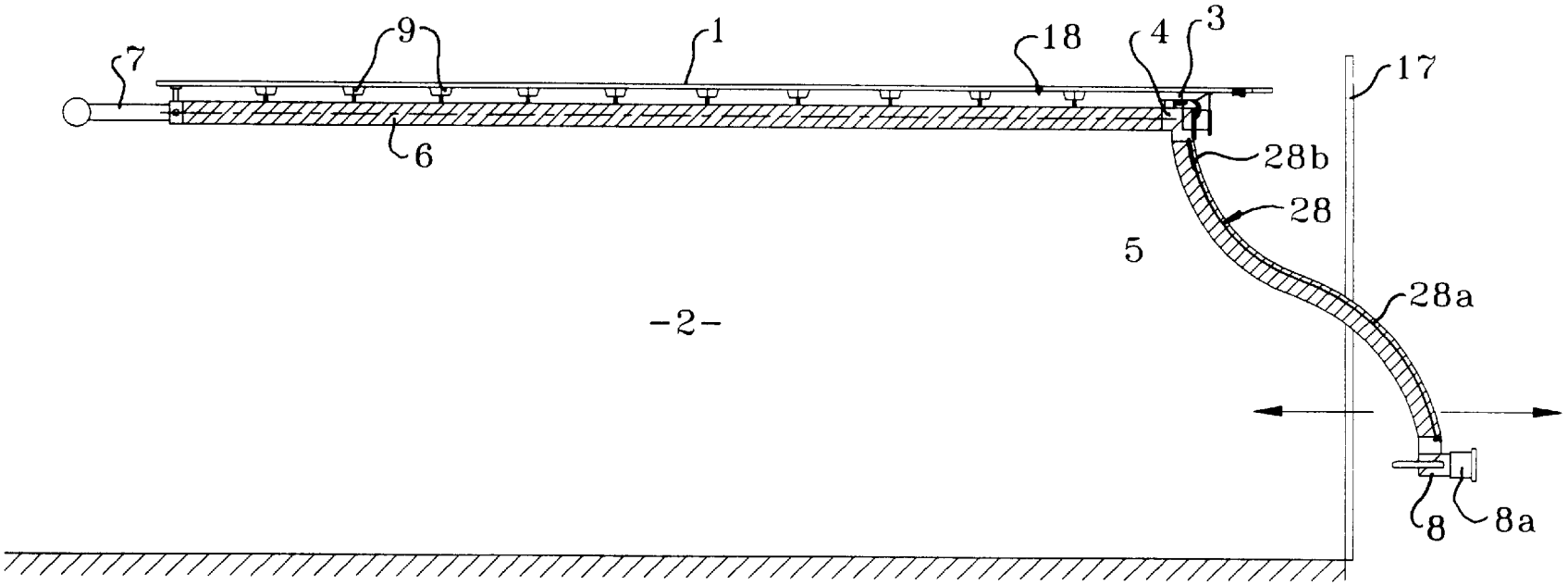
FIG. 1 is a side view of the apparatus at the instant at which the extraction socket is released from the exhaust of the vehicle which is driving off.

The brake shoe 12 is released from the running rail 1 through this and the carriage 3 is freed. As the vehicle is put back into the vehicle shed 2, the carriage can go into its rest position shown in FIG. 1, under the action of the reversing vehicle and the action of the elastically tensioned connecting hose 6. Since the extraction socket 8 is standing ready directly in the door region and can be clamped on to the exhaust, no exhaust gases get into the vehicle shed and the driver does not first have to fetch the extraction socket 8 and the hose 5 out of the shed.

Figure 6:
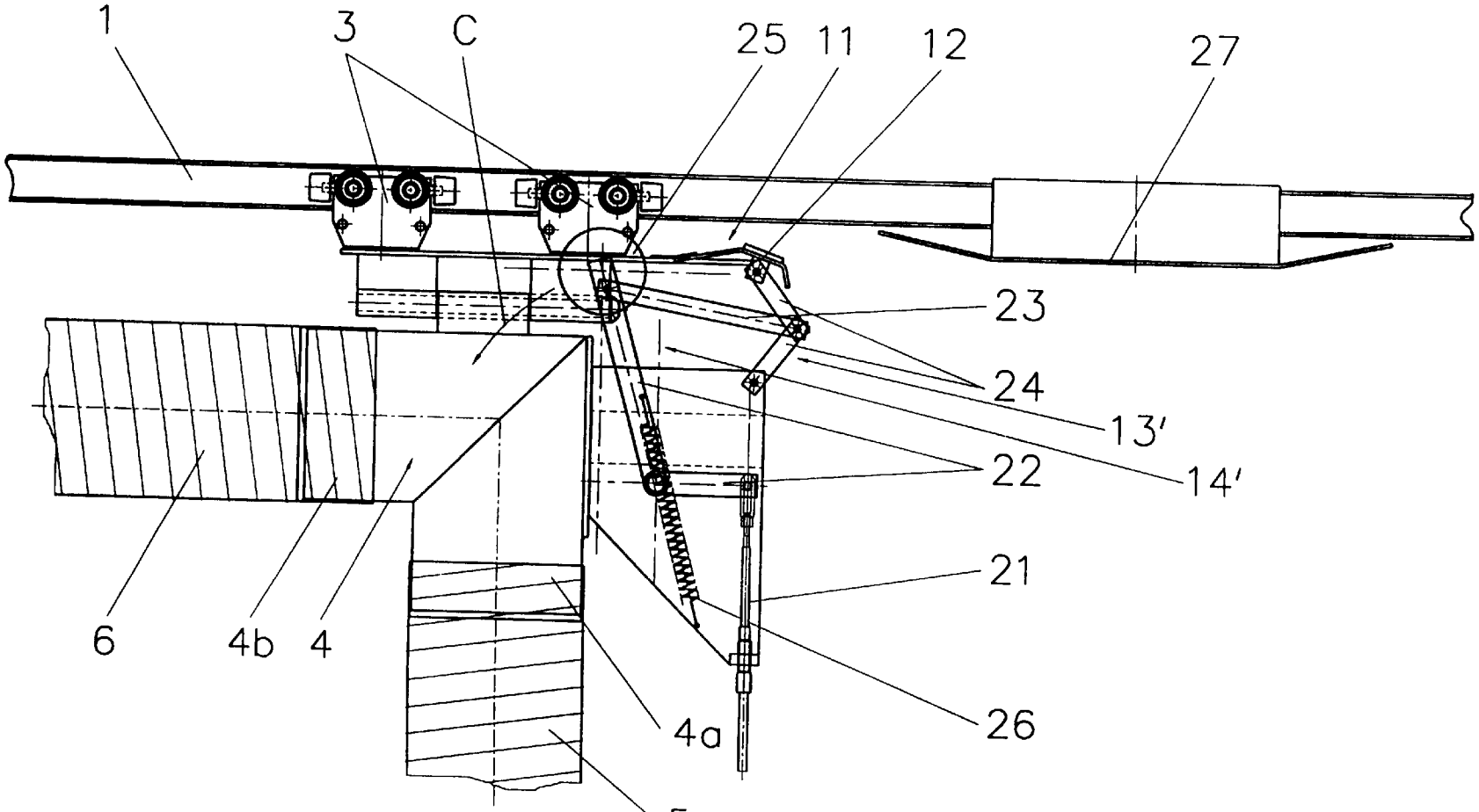
FIG. 6 shows a second embodiment of the carriage with its brake device released.
Figure 7:
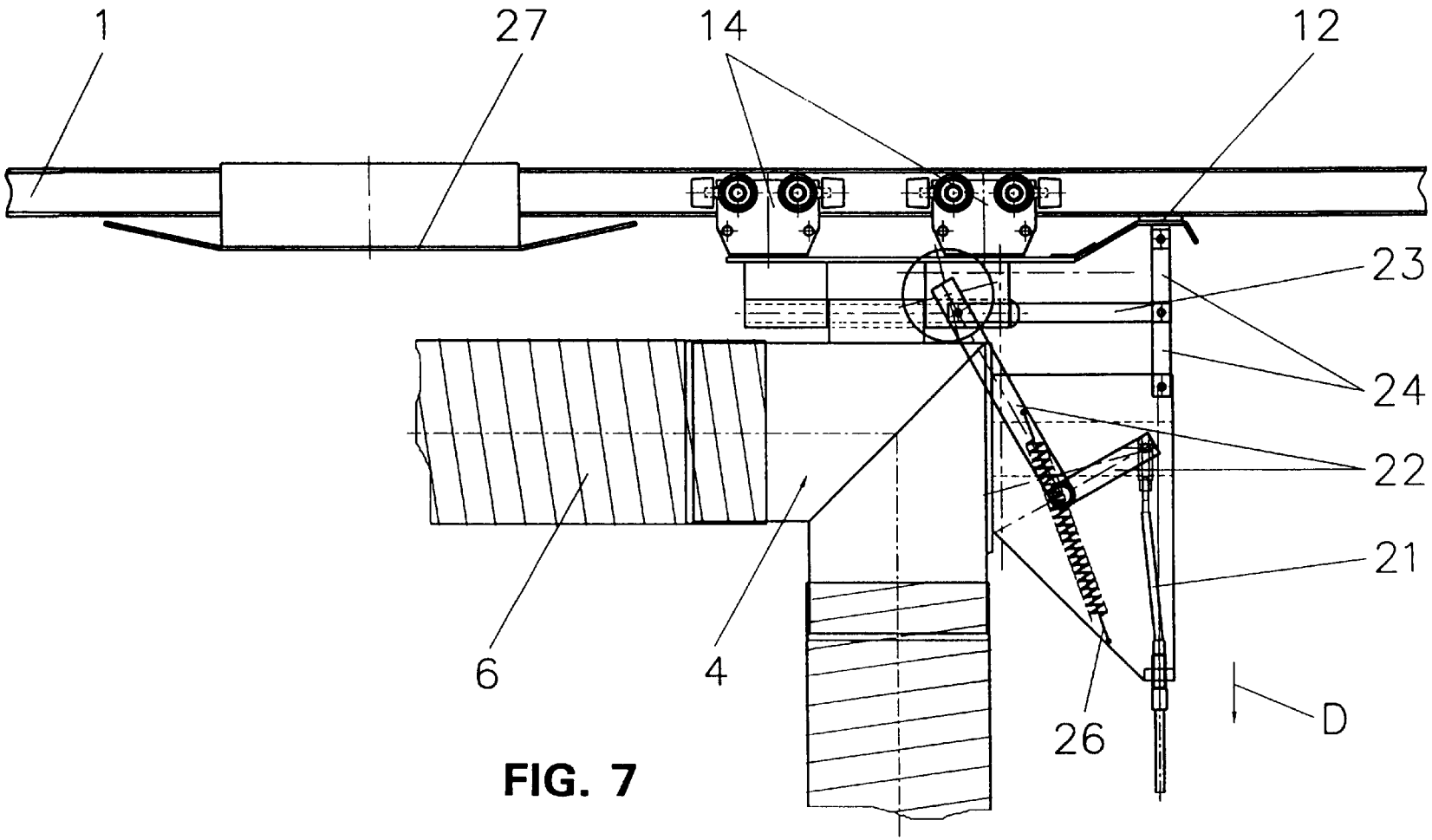
FIG. 7 is further side view of this embodiment in the braked position.
Figure 8:
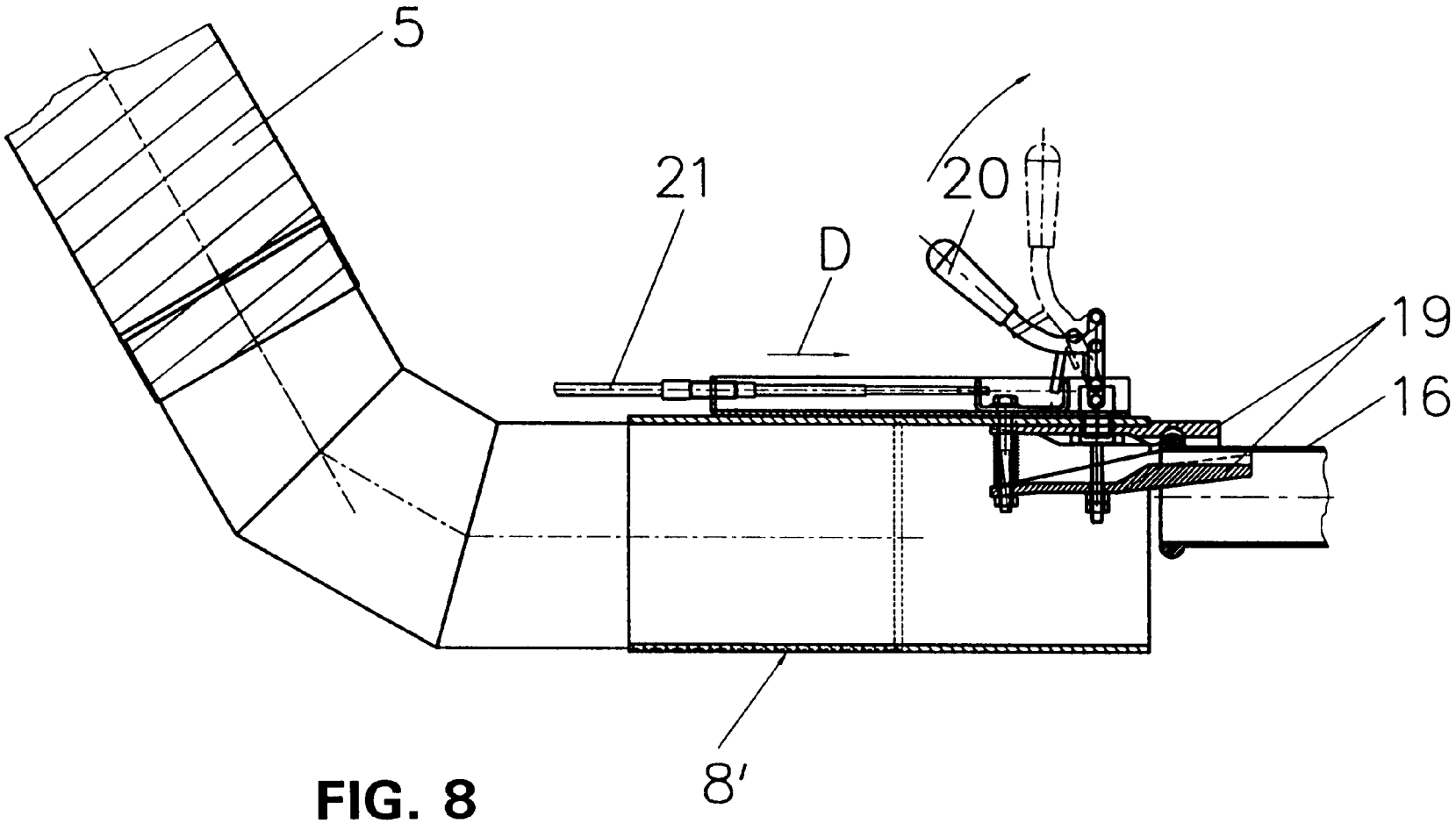
FIG. 8 is a longitudinal section of the associated extraction socket.

In the embodiment shown in FIGS. 6 to 8 the extraction socket 8' has a clamping jaw 19, which can be actuated by a manual lever 20. The clamping jaw is clamped on to the exhaust 16 in FIG. 8. A Bowden cable 21 leads to the mechanical control device 14' provided on the carriage 3. This control device 14' has a control lever 22 in the form of a crank lever, which is connected at one end to the Bowden cable 21 and at the other end to a link 23 of the actuating device 13'. The brake linkage 24 is also part of this actuating device. A roller 25 is arranged on the free end of the control lever. A tension spring 26 which can be moved over a dead point also acts on the control lever 22.

When the vehicle 15 drives out of the vehicle shed 2 and its exhaust 16 has reached the door region, the carriage 3 comes into the region of the control curve 27 attached to the running rail 1. This presses on the roller 25 and swings the control lever in the direction of the arrow C. The Bowden cable 21 is pulled by this and releases the clamping jaw 19 from the exhaust 16. The manual lever 20 turns into its chain-dotted position. Moreover the brake linkage 24 is brought into its straightened out position by the link 23 and the brake shoe 12 is thereby pressed on to the running rail 1. The carriage 3 is thus braked in the door region in its stand-by position and held arrested there. When the vehicle returns and its exhaust has reached the door region, the extraction socket 8' is clamped on to the exhaust 16 again, in that the manual lever 20 is brought out of its chain-dotted position into its position shown in full lines in FIG. 8. The Bowden cable 21 is hereby pulled in the direction D and turns the control lever 22 back again into its initial position. The brake is thus released and the carriage 3 can be moved freely again.

In order that the carriage 3 shall actually reach the door region when the vehicle is driven out, the uncoupling of the extraction socket 8, 8' and the braking of the carriage should not take place too early. The braking path of the carriage 3 is relatively short and if the vehicle is driven out wildly, the extraction socket 8, 8' and the extraction hose 5 experience a substantial acceleration, which could lead to the extraction hose 5 tearing. In order to prevent this at least one control cable 28 is provided between the pipe connector 4*a* and the extraction socket 8, 8'. Preferably however, two control cables 28 are provided, acting on diametrically opposite sides of the pipe connector 4*a* and the extraction socket 8, 8'. Each control cable 28 consists of a cable 28*a* and a tension spring 28*b*. Moreover the length of the un-extended extraction hose 5 is at least 50 cm more than the vertical distance A between the pipe connector 4*a* and the extraction socket 8, 8' resting on the shed floor 2*a*. The lengths of the control cables 28 and their spring force are so dimensioned that, as is shown in FIG. 2, with the extraction hose 5 hanging down approximately vertically, the extraction socket 8 touches the shed floor 2*a*. The effect of the greater length of the extraction hose 5 is that, when the extraction socket is released from the exhaust, the extraction socket is braked by the control cable 28, before the inertial forces of the extraction socket can be transferred to the extraction hose. Too strong a loading of the extraction hose and thus tearing thereof are thereby prevented. Moreover the extraction socket 8, 8' can remain on the exhaust a relatively long time, until this has left the vehicle shed. Emission of exhaust gas into the vehicle shed is thus prevented. The control cables 28 further result in the extraction socket 8, 8' being caught and landing on the floor softly, where it is then pulled back over the floor into the door region of the shed under the action of the force of the tension springs 28*b*. The extraction socket then provides braking action, especially if it has a rubber cuff 8*a*, so that the extraction hose 5 is also braked and this and the extraction socket are prevented from flying back. Injury to personnel is also avoided by this. In the stand-by position the extraction hose 5 and socket 8, 8' assume the ready position shown in FIG. 2, in which only the extraction socket 8 still contacts the shed floor 2*a*. The control cables 28 prevent the extraction hose 5 from lying on the shed floor 2*a* on account of its excess length.

In order to increase the operating reliability of the exhaust gas extraction apparatus it is further advantageous if at least the pipe connector 4*a* for the extraction hose 5, but advantageously the whole pipe bend 4, is pivotally mounted on the carriage 3 about an axis Al running parallel to the running rail 1. This prevents oblique forces, which can act on the extraction hose 5, also being transferred to the carriage 3. The ability of the carriage 3 to move freely could be prevented by such oblique forces or it could even bind completely in the running rail 1.

What is claimed is:

1. An exhaust gas extraction apparatus for a vehicle shed, with a running rail arranged in the exit direction of a vehicle in an upper shed region, a carriage for travel thereon, an extraction hose hanging down from the carriage, with an extraction socket disposed at a lower, free end of the extraction hose and capable of being clamped onto an exhaust pipe of the vehicle, and a connecting hose which extends elastically in a longitudinal direction, the connecting hose is connected at one end to the carriage and at the other end to a collecting line and carried from the running rail by a plurality of supports with rollers movable in the running rail, wherein a brake device is arranged on the carriage, with a movable brake shoe for pressing onto the running rail in its braking position and with a pneumatic, electrical, electromagnetic or mechanical actuating device, and a control device is provided which controls the actuating device on release of the extraction socket from the exhaust pipe, the actuating device bringing the brake shoe into the braking position.

2. Apparatus according to claim 1, wherein the control device acts on the actuating device with a time delay.

3. Apparatus according to claim 1, wherein the release of the actuating device takes place by means of the control device on coupling the extraction socket to the exhaust pipe.

4. Apparatus according to claim 1, wherein the extraction socket includes a pneumatically operated cuff and a pneumatic control device is provided for effecting pressurization of a pneumatic cylinder of the actuating device on venting of the cuff and conversely for initiating venting of the pneumatic cylinder when the cuff is pressurized.

5. Apparatus according to claim 1, wherein the control device is provided on the carriage and comprises a control lever which acts on one hand via a Bowden cable on a clamping jaw of the extraction socket and on the other hand via a link on a brake linkage of the brake device, and a control profile is connected to the running rail and cooperates with the control lever at a vehicle position in which the extraction socket is to be released from the exhaust pipe.

6. Apparatus according to claim 1, wherein the extraction hose is elastically extensible in its longitudinal direction, the length of the un-stretched extraction hose being at least 50 cm longer than a vertical distance between a pipe connector for the extraction hose on the carriage and the extraction socket resting on the shed floor, and in that at least one control cable consisting of a cable and a tension spring is provided between the pipe connector and the extraction socket, the length and spring force of the control cable causing the extraction socket to touch the shed floor is hanging approximately vertically from the pipe connector.

7. Apparatus according to claim 5, wherein two control cables are attached on diametrically opposite sides of the pipe connector and the extraction socket.

8. Apparatus according to claim 1, wherein a pipe connector for the extraction hose is pivotally attached on the carriage about an axis running parallel to the running rail.

9. Apparatus according to claim 1, wherein a cam is arranged in a region of the running rail to release the extraction socket from the exhaust when the carriage reaches the location of the cam.

10. Apparatus according to claim 1, wherein the control device controls the actuating device through a control pulse.

* * * * *

UNITED STATES PATENT AND TRADEMARK OFFICE

CERTIFICATE OF CORRECTION

PATENT NO. : 6,139,422
DATED : October 31, 2000
INVENTOR(S) : Hans Blaschke

It is certified that error appears in the above-identified patent and that said Letters Patent is hereby corrected as shown below:

Column 6,
Lines 34-45, change "the shed floor is hanging" to -- the shed floor when the extraction hose is hanging --.

Signed and Sealed this

First Day of January, 2002

*Attest:*

*Attesting Officer*

JAMES E. ROGAN
*Director of the United States Patent and Trademark Office*